United States Patent [19]

Anderson

[11] 3,940,818

[45] *Mar. 2, 1976

[54] AIR BLOWING MACHINE

[76] Inventor: Clifford E. Anderson, 6440 Hillcroft, Houston, Tex. 77036

[ * ] Notice: The portion of the term of this patent subsequent to Apr. 30, 1991, has been disclaimed.

[22] Filed: Feb. 26, 1973

[21] Appl. No.: 335,576

[52] U.S. Cl. ..... 15/3.53; 15/344; 51/71; 51/266; 418/63

[51] Int. Cl.[2] ..... A47L 5/24; B43L 19/02

[58] Field of Search ..... 15/3.53, 344; 418/63, 151, 418/188; 51/71, 266

[56] References Cited

UNITED STATES PATENTS

| | | | |
|---|---|---|---|
| 2,737,341 | 3/1956 | Bitzer | 418/188 X |
| 3,193,192 | 7/1965 | Carter, Jr. | 418/63 |
| 3,254,629 | 6/1966 | Dicorte | 15/330 X |
| 3,548,436 | 12/1970 | Henrich | 15/3.53 |
| 3,806,977 | 4/1974 | Anderson | 15/344 X |

*Primary Examiner*—Harvey C. Hornsby
*Assistant Examiner*—C. K. Moore

[57] ABSTRACT

A motor driven machine, such as a machine capable of holding and imparting movement to a tool, for example, which may be an eraser strip that is brought to bear upon a surface, such as a paper surface, for erasure of undesirable markings therefrom. The machine includes an internal air supply mechanism having the capability of directing a flow of compressed air against the work surface in the area of contact between the tool and the surface for the purpose of cooling the surface and the tool as well as blowing particles from the immediate area of engagement between the tool and the surface. The machine may include a holding device for supporting the machine in proper position to be grasped when the machine is not in use.

18 Claims, 9 Drawing Figures

FIG. 6
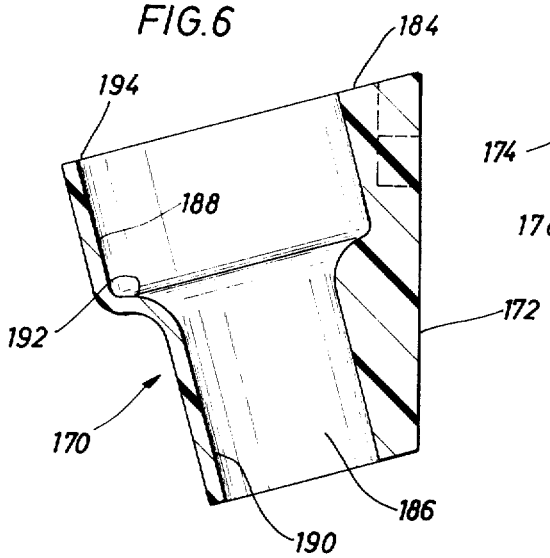
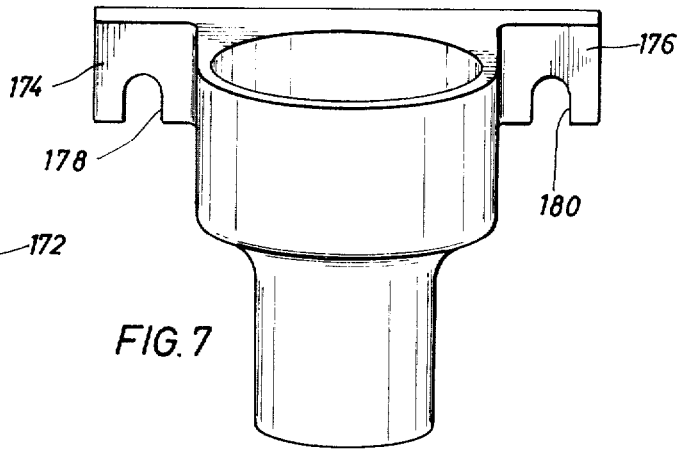
FIG. 7
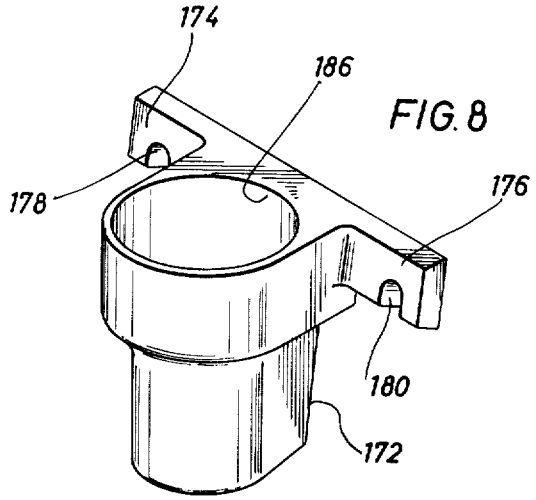
FIG. 8
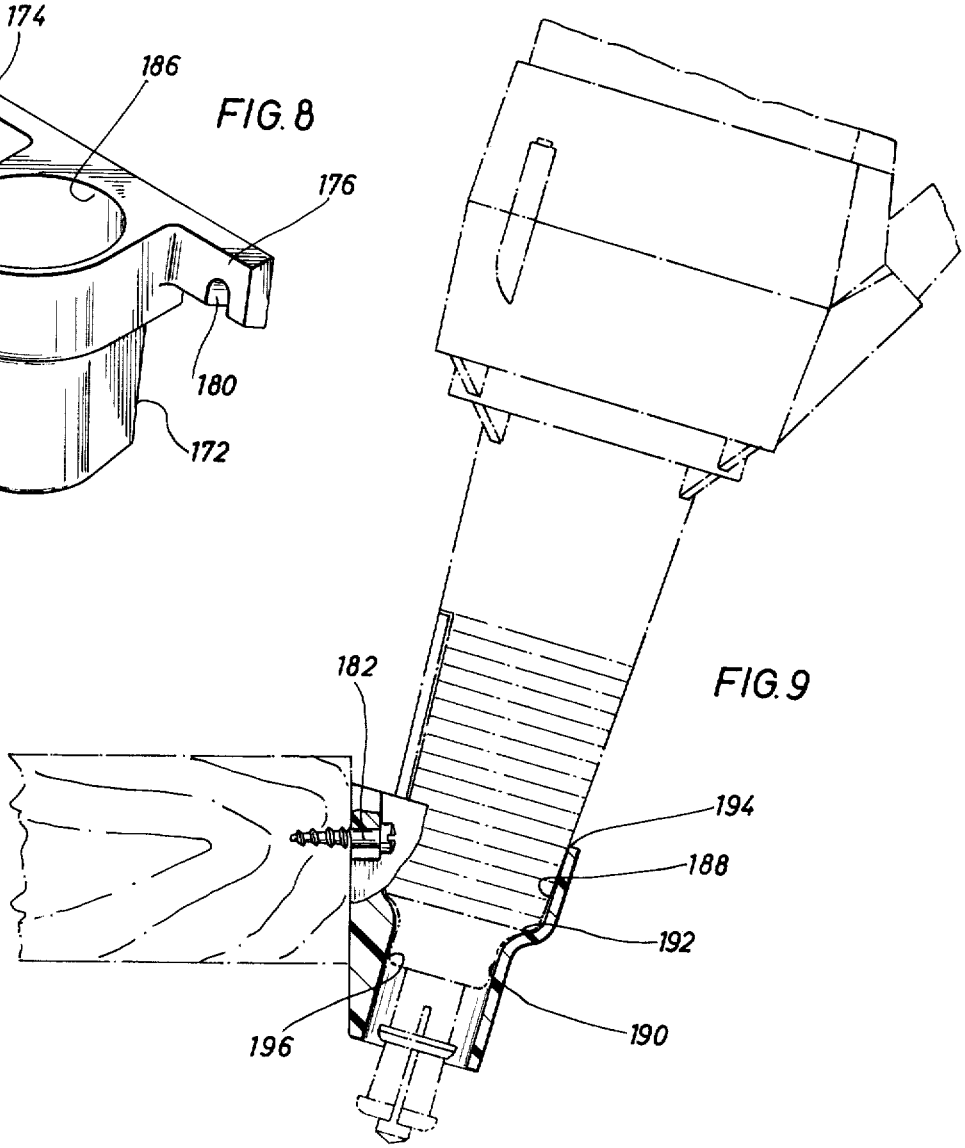
FIG. 9

AIR BLOWING MACHINE

FIELD OF THE INVENTION

This invention relates generally to machines provided for doing work on various work surfaces, such as metal, wood or paper surfaces, for example, and more particularly relates to a motor driven machine having the capacility of directing a flow of air against the work surface for purposes of cooling the tool driven by the machine and accomplishing removal of particles such as grit, chippings, etc. While the invention is discussed herein as it relates to motor driven erasing machines, it is not intended to limit the scope of the invention to erasing machines, it being obvious that the invention may extend to other useful machines such as hand grinders, engraving machines and the like without departing from the spirit and scope of the invention.

BACKGROUND OF THE INVENTION

Mechanically driven erasing machines, such as those driven by both AC and DC electric motors of both cord and cordless type, have been utilized for many years. An erasing machine of this nature will generally incorporate a motor driven mechanism that is disposed with a motor housing, which drive mechanism is connected to a collet chuck mechanism that receives and holds a generally cylindrical strip of erasing material, commonly known as an eraser strip. Upon manual manipulation of an on-off switch, the erasing machine, which is adapted to be hand held, may be energized to cause rapid rotation of the eraser and may be brought to bear upon a surface to be erased in order to remove undesirable markings therefrom.

Although this specification is directed generally to application of the invention to rotary erasing machines, it is not intended to so limit the scope of the invention, it being obvious that other types of motorized erasing machines may be provided with air supply mechanisms within the spirit and scope of the invention. It is contemplated that the present invention be capable of employment in erasing machines having erasers other than the elongated eraser strips commonly employed. The term "eraser strip" is therefore to be construed herein as encompassing eraser structures of any desirable configuration.

As an erasing operation is conducted, the surface being erased is eroded to some extent and erasure particles become separated from the eraser strip and become deposited on the surface being along with particles eroded from the surface, thereby contaminating the surface. Periodically, it is necessary, in order to facilitate good visibility of the surface being erased, for the operator of the machine to cease the erasing operation and remove the erasure particles from the surface by means of a brush or any other acceptable erasure particle removable device. Ceasing the erasing operation in this manner and periodically removing the erasure particles from the surface obviously detracts from the commercial effectiveness of the erasing operation, because of the amount of time utilized in brushing of the erasure particles or grit away from that portion of the surface being erased.

Another problem, encountered in the use of mechanical erasing machines, concerns the generation of heat between the rapidly rotating eraser strip and the surface being erased. When a rotating eraser strip is brought to bear upon a paper surface, to remove pencil or ink lines therefrom, a draftsman, utilizing the machine, must exercise great care to prevent the contact area from becoming hot enough to burn through the paper as well as becoming hot enough to cause deterioration of the eraser strip. When erasing ink or pencil lines from a plastic film surface, a draftsman may not be allowed to utilize a mechanical erasing device because the film is so susceptible to burnthrough due to heat deterioration of the film. It is quite difficult to erase markings from a plastic surface without generating enough heat to burn through the surface. As the draftsman applies the rotating eraser strip to the surface, it is typically necessary for the machine to be periodically lifted from the surface for cooling and this, of course, adds time to the erasing operation and detracts from the commercial feasibility thereof.

Heat generated during an erasing operation may cause burnishing or slight discoloration of a paper surface, being erased, and may detract from the ability of the paper to receive ink or pencil markings after being erased. It may be necessary, after utilizing a mechanical eraser, for erasing pencil or ink lines on paper, to clean the erased surface with a manually applied eraser before applying ink or pencil lines thereto. Of course, between the mechanical and manual erasing operations, it is necessary to brush away the erasure particles. Considerable time may therefore be expended in the drafting and erasing operation which is, of couse, undesirable.

Another factor that may detract from mechanical erasing operation, is the amount of wear that occurs on rotating eraser strips because of the great amount of heat that is generated. Frequently, a rapidly rotating eraser strip will become sufficiently heated during an erasing operation that the eraser material will break down and crumble away quite rapidly. Heat deterioration of the eraser strip in this manner obviously substantially increases the cost of the erasing operation, as well as substantially increasing the amount of erasure particles that become deposited on the surface being erased, which particles of course must be brushed away before a drafting operation can be continued.

A draftsman drawing with pencil or ink on a paper surface will typically employ the following erasing sequence during drafting operations:

1. Pick up erasing machine.
2. Erase.
3. Lay erasing machine down.
4. Pick up brush.
5. Brush erasure particles away from the erasing area and inspect erasure.
6. Lay brush down.
7. Pick erasing machine up again.
8. Touch up incomplete erasure or erase over lines again to improve quality of erasure.
9. Lay erasing machine down.
10. Pick up brush.
11. Brush erasure particles away from erasing area and reinspect erasure.
12. Lay brush down.
13. Repeat steps 7–12 if necessary.
14. Begin drawing again.

It is therefore a primary object of the present invention to provide a novel air blowing erasing machine that provides the draftsman with the capability of utilizing the following sequence during erasing operations.

1. Pick erasing machine up.

2. Erase and inspect erasure simultaneously, because grit or erasure particles will have been removed from the surface being erased during application of the eraser strip to the surface.

3. Lay erasing machine down.

4. Begin drawing again.

It is a further object of the present invention to provide a novel mechanically driven air blowing machine such as an erasing machine that gives the erasing machine the capability of directing a flow of compressed air against the surface being erased, immediately adjacent the point of contact between the eraser strip and the surface, which flow of compressed air is sufficiently great to blow erasure particles away from the area being erased, thereby providing the draftsman with good visibility of the area being erased at all times.

It is an even further object of the present invention to provide a novel mechanically driven air blowing machine having the capability of developing a flow of gaseous medium for achieving cooling of the contact area between the tool carried by the machine and the surface on which work is being done, thereby preventing over heating of the work surface and preventing excessive or erosion of the tool carried by the machine during the working operation.

It is an even further object of the present invention to provide a novel mechanically driven air blowing machine having the capability of developing a flow of compressed air for use in general blowing, such as blowing chips, grit or cuttings from a surface being machined, sanded or otherwise worked upon.

Among the several objects of the present invention is noted the contemplation of a novel mechanically driven air blowing erasing machine, which promotes optimum erasing at nominal eraser strip cost by preventing excessive wear of eraser strips during erasing operations.

It is an even further object of the present invention to provide a novel mechanically driven air blowing erasing machine incluing an air supply mechanism that may be disposed within the erasing machine and may be driven by the motor of the erasing machine.

It is also an object of the present invention to provide a novel air blowing erasing machine utilizing an eccentric pump for causing pulsating flow of air which pump is capable of substantially vibration free operation.

It is also an object of the present invention to provide a novel air blowing erasing machine that may be supported in proper position to be readily grasped by a draftsman when not in use.

Other improvements of the function and facility of design will become apparent to one skilled in the art upon an understanding of the illustrative embodiments about to be described and various advantages, not referred to herein, will occur to one skilled in the art upon employment of the invention in practice.

BRIEF DESCRIPTION OF THE DRAWINGS

In order that the manner in which the above recited advantages and objects of the invention are attained, as well as others, which will become apparent, can be understood in detail, more particular description of the invention, briefly summarized above, may be had by reference to the specific embodiments thereof that are illustrated in the appended drawings, which drawings form a part of this specification. It is to be understood, however, that the appended drawings illustrate only typical embodiments of the invention and therefore are not to be considered limiting of its scope, for the invention may admit to other equally effective embodiments.

In the Drawings:

FIG. 6 is a sectional view in elevation representing a holding device provided for supporting the machines of FIGS. 1, 2 and 5.

FIG. 7 is a front elevational view of the holding device illustrated in FIG. 6.

FIG. 8 is an isometric view illustrating the machine holder device of FIGS. 6 and 7.

FIG. 9 is a sectional view of the machine holder structure of FIGS. 6, 7 and 8, illustrating assembly of the holder device to the edge portion of a drafting table or other suitable structure and showing an erasing machine being supported by the holder device in position for ready grasping.

SUMMARY OF THE INVENTION

The present invention is directed to the provision of a motor-driven, air blowing machine, such as an erasing machine, that may be driven by an external source of power, such as any conventional 110-volt AC circuit or, in the alternative, may be self-contained any may include a battery-operated drive motor and a battery energized power supply. The erasing machine, in its simplest form, may comprise a housing within which is disposed an electrically enerigized AC or DC motor that may be connected in driving relationship with a chuck mechanism disposed within the housing and adapted to receive and firmly hold a strip of erasing material. The erasing strip cooperates with the chuck mechanism to define an air passage along the length of the strip of erasing material for the purpose of conducting a flow of air along the erasing strip and causing the same to be directed against the surface being erased. If desired, the erasing strip may be provided with an external groove that cooperates with the wall structure of the chuck mechanism to define the air passage. In the alternative, the erasing strip may be provided with an axial passage within which may be received an air supply conduit.

An air supply mechanism may also be disposed within the housing structure of the erasing machine and may be connected in driven relation with the electrically energized motor. The air supply mechanism may comprise an eccentrically oscillatable rotor type pump mechanism that may be counterbalanced in such manner that very little vibration, if any, will be transmitted to the structure of the erasing machine. Air may be drawn into the pump structure through a filtered orifice and may be compressed by the eccentrically oscillatable rotor any may be conducted through the air passage along the length of the eraser strip where it may be directed in pulsating manner against the surface being erased, thereby blowing away erasure particles that might have become deposited and achieving cooling of the eraser strip to prevent excessive eraser wear.

Means is also provided for supporting the erasing machine in essentially the operating position thereof, thereby allowing the erasing machine to be stored when not in use in a position to be grasped and utilized in a convenient and efficient manner.

DESCRIPTION OF PREFERRED EMBODIMENT

Figure 1:
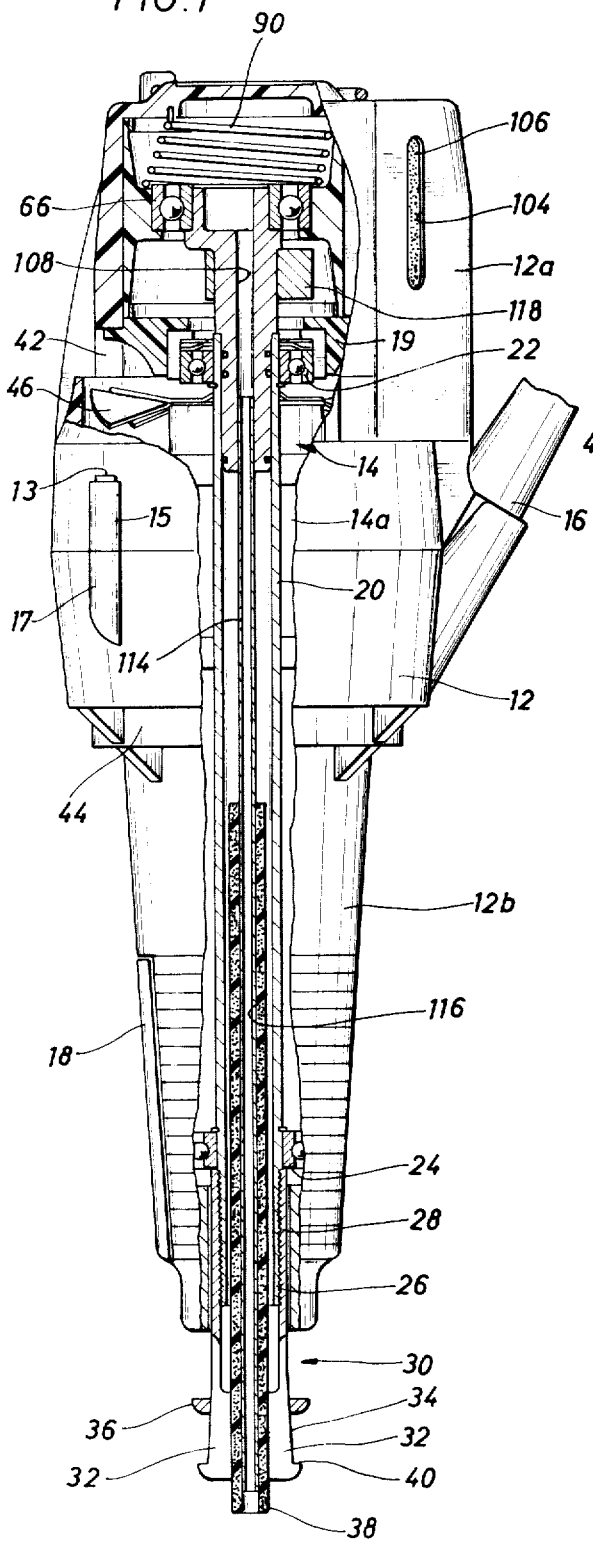
FIG. 1 is an elevational view having parts thereof broken away and shown in section, illustrating a motor driven, air blowing, machine constructed in accordance with the present invention.

With reference to the drawings, wherein like structures are indicated by like reference numerals and with particular reference to FIG. 1, there is illustrated an erasing machine generally at 10 having a housing structure 12 operatively supporting a rotary electric motor 14 therein having an armature 14a. The housing may comprise upper and lower housing sections 12*a* and 12*b* that are maintained in assembly by screws 13 extending through apertured flanges 15 defined in housing section 12*a* and being threadedly received by threaded holes defined in connector bosses 17 provided on the lower housing section 12*b*. The motor 14, as indicated above, may be energized by either AC or DC electric current as desired. As is typically the case, the motor 14 may be powered by any suitable source of alternating current, for example 110 volt AC, which may be supplied through a conventional power cord, a part of which is shown at 16. The erasing machine may be provided with a finger operated switch actuator 18 for the purpose of actuating a switch and selectively controlling energization of field coils supported by the housing to induce rotation to the armature of the motor 14. The armature 14*a* of the motor 14 may be disposed in driving connection with a chuck tube 20 that may be supported for rotation within the housing 12 and upper bearing support flange 15 by upper and lower bearings 22 and 24, respectively. When the motor 14 is energized, therefore, the armature will cause rotation of the chuck tube 20 within the housing.

The chuck tube 20 may be provided with a lower externally threaded extremity 26 that may receive the internally threaded upper extremity 28 of a chuck mechanism, identified generally at 30. The chuck tube 20 is adapted to receive a generally cylindrical strip of eraser material, typically referred to as an eraser strip, which is held in fixed relation to the chuck tube by the chuck mechanism 30. The lower extremity of the chuck mechanism 30 may be longitudinally split in such manner as to define a plurality of collet segments 32 which are movable relative to one another. The chuck mechanism 30 may be provided with a tapered external cam surface 34 about which may be received a locking ring 36. After a strip of eraser material, such as shown at 38 in FIG. 1, has been inserted through the chuck mechanism and into the chuck tube 20, the locking ring 36 may be moved downwardly reacting against the tapered cam surface 34 of the collet chuck mechanism, thereby causing the segments 32 to move into releasable frictional locking engagement with the outer periphery of the eraser strip. Shoulders 40 are provided at the lower extremities of the segments 32 to prevent the locking ring from becoming disassembled from the chuck mechanism.

When the erasing machine is utilized during sustained erasing operations, the electric motor 14 may develop sufficient heat that cooling is necessary. Accordingly, the housing structure 12 may be provided with upper and lower vent openings 42 and 44 respectively that allow upward circulation of air through the motor portion of the erasing machine, which circulation may be enhanced by a fan assembly 46 that may be secured through the armature of the motor 14, thereby causing the fan to rotate when the motor 14 is energized.

To utilize the erasing machine 10, the operator would grasp the lower housing section 12*b* of the machine below the motor cover portion of the housing and would depress the switch operating element 18 which induces a switch to close thereby completing the electrical circuit of the motor 14. The eraser strip 38, through its connection with the chuck mechanism 30, will be rotated rapidly by the motor and may be applied to a surface to cause the surface to be erased free of any undesirable markings.

Figure 3:
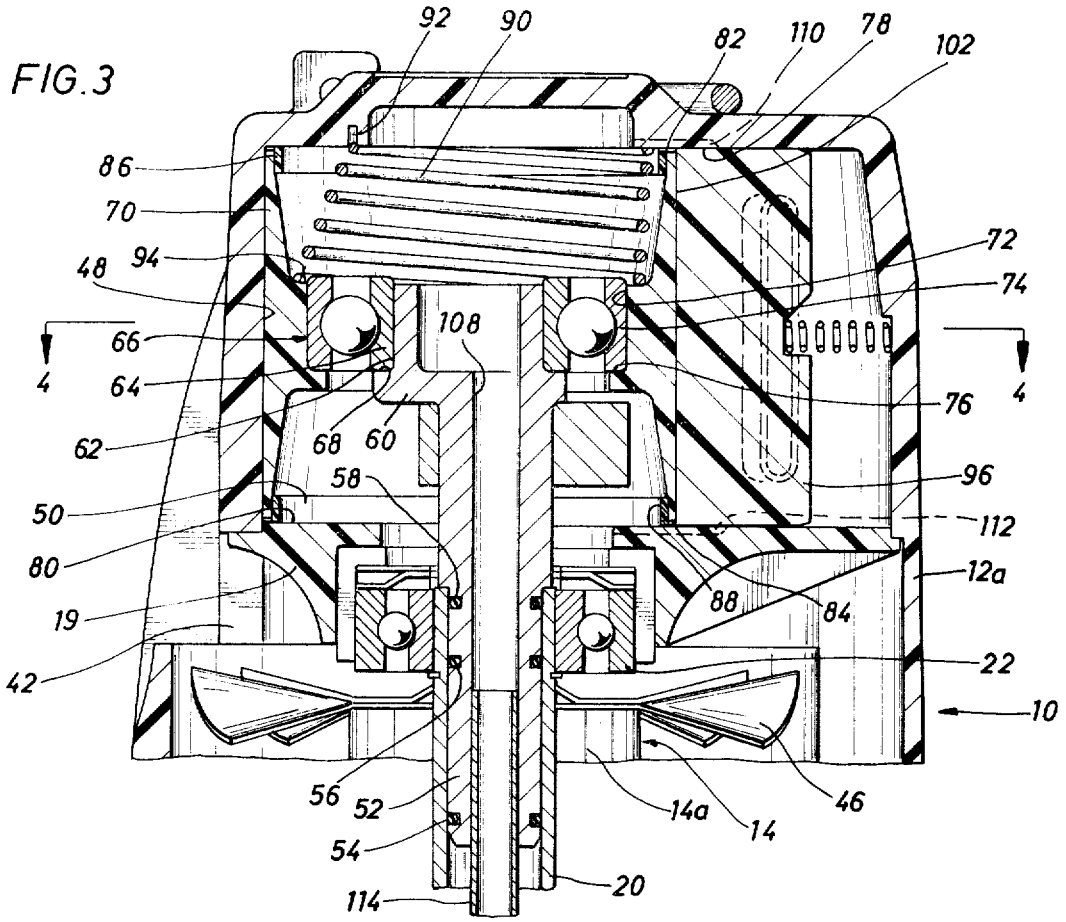
FIG. 3 is an enlarged sectional view in elevation showing the upper portion of the machine structure of FIG. 2.

As indicated above it is desirable during erasing operations to provide means for removing any accumulation of erasure particles in the immediate area being erased and to provide for cooling of both the eraser strip and the surface being erased. One suitable means for accomplishing both cleaning and cooling may conveniently take the form of an air supply mechanism or pump disposed within the housing section 12*a* and being adapted to deliver a flow of air through the air passage defined along the length of the eraser strip. Referring now to FIG. 3, the upper housing section 12a of the housing 12 may have a generally cylindrical internal wall surface 48 that cooperates to define an internal pump chamber 50. A pump shaft 52 may be received in close fitting relation within the upper extremity of the chuck tube 20 and may be maintained in sealed engagement relative to the chuck tube by means of a plurality of sealing elements 54, 56 and 58, such as elastomer O-rings or the like, received within appropriate annular grooves defined in the external periphery of the pump shaft 52. The sealing elements 54, 56 and 58 also serve to properly align the pump shaft relative to the chuck tube 20 and to maintain sufficient frictional engagement therebetween to cause the pump shaft 52 to be rotated along with the chuck shaft 20. The chuck shaft/pump shaft sealing and driving connection shown facilitates accurate rotation of the pump shaft under control of the upper bearing 22.

The upper extremity of the pump shaft 52 may be provided with an eccentric portion 60 that may define a generally cylindrical bearing support surface 62,. which surface may be disposed in eccentric relation to the pump shaft 52 and may be disposed to receive the inner race 64 of a rotor bearing, illustrated generally at 66. The eccentric portion 60 of the pump shaft 52 may define a support shoulder 68 against which the inner race 64 of the bearing may seat to properly position the bearing within the pump chamber of the housing section 12a.

A generally cylindrical rotor 70 may be disposed within the pump chamber 50 of the housing and may define a generally cylindrical surface 72 adapted to receive the outer race 74 of the bearing 66 in press-fitted relation therein. A support shoulder 76 may be defined by an internal flange formed within the rotor 70 and may provide locating support for the outer race 74 of the bearing to positively locate the rotor element 70 relative to the bearing and relative to upper and lower generally planar surfaces 78 and 80 that cooperate with the cylindrical surface 48 to define the pump chamber 50.

It is desired that the upper and lower extremities 82 and 84 respectively of the rotor 70 be disposed in close proximity to the planar surfaces 78 and 80 without actually touching the same in order that air leakage and friction losses between the rotor and the planar surfaces be prevented or maintained as low as possible. If the rotor were to establish sealing engagement with the planar surfaces 78 and 80, it is obvious that air leakage would be maintained at a very low or virtually nonexistent level. However, under such circumstances, friction losses created by frictional engagement of these surfaces would be quite high and substantial power loss would be incurred in overcoming the forces of frictional engagement. In order to maintain gas leakage past the rotor at an acceptable minimum and to facilitate inexpensive manufacture of both the rotor and housing structure with rather wide manufacturing tolerances, upper and lower sealing rings 86 and 88, respectively, may be received in press-fitted relation within the extremities of the rotor 70. The sealing rings 86 and 88 may be composed of a low friction material, such as polytetrafluorethylene, which may or may not, as desired, be combined with a filler material of wear-resistant composition. To achieve proper fitting relationship with the rotor element 70 and with the planar surfaces 78 and 80, the seal rings may be inserted slightly into lightly press-fitted relation with the respective end portions of the rotor during preliminary assembly of the air supply mechanism. As the upper and lower housing sections 12*a* and 12*b* are brought into assembly, the seal rings 86 and 88 will be moved further into seated relationship with the rotor by the respective planar surfaces 78 and 80, thereby establishing proper fitting relationship between the seal rings and the planar surfaces. Immediately after assembly the seal rings will be rather tightly fitted against the planar surfaces but, upon initial rotation of the rotor 70 the seal rings, will be forced by the surfaces 78 and 80 further into seated relationship with the rotor structure, thereby establishing minimal but adequate clearance between the seal rings and the planar surfaces. The seal rings will be prevented from shifting toward the center of the rotor element by the interference fit thereof within the respective end portions of the rotor. The seal rings, as disposed thusly, will effectively prevent compressed air from flowing past the upper and lower extremities relative the rotor as the rotor is moved eccentrically reltive to the planar surfaces of the housing structure.

It has been determined through tests that considerable energy will be expended, thereby detracting from the erasing ability of the erasing machine or requiring that it be provided with a more expensive motor having higher torque capability, if the rotor element 70 is allowed to rotate within the pump chamber as it is oscillated therein upon rotation of the pump shaft 52. One suitable means for limiting rotation of the rotor 70 . . onveniently take the form illustrated in FIG. 3 where a torsion spring 90 may be disposed within the pump chamber 50 and may be interposed between the housing structure and the rotor. The spring 90 may be provided with a locking projection 92 that may be received within a blind bore or recess formed in the upper portion of the housing structure, thereby retarding relative rotation of the spring 90 and the housing structure. The lower portion of the spring 90 may be merely disposed in engagement with an annular spring recess 94 defined in the rotor structure immediately outwardly of the bearing 66. Frictional engagement established between the spring 90 and the rotor element will prevent the rotor from freely rotating within the pump chamber, but will allow the rotor to have some limited degree of rotary movement, thereby insuring even wearing of the seal elements. This feature effectively prevents the rotor element from freely rotating and causing development of excessive motor retarding forces and also effectively facilitates development of optimum seal wear characteristics which promotes the operating life of the erasing mechanism.

In order to provide a pumping function, it is necessary that means be provided to control the flow of air as the air is moved about within the pumping chamber by eccentric movement of the rotor. In accordance with the present invention, one suitable means for providing effective control of air movement may conveniently take the form of a vane element 96 that may be movably received within a vane recess 98 defined in the wall structure of the housing. An urging means, such as a compression spring 100 or other suitable element, may be interposed within the recess 98 and may bear upon the vane element 96, thereby urging the vane element into contacting relationship with the generally cylindrical outer surface 102 of the rotor 70. As the pump is operated the vane element is reciprocated within the recess 98 by the rotor as the rotor element oscillates within the pump chamber. The vane element 96 may, if desired, be composed of a low friction wear-resistant material such as filled polytetrafluorethylene to prevent excessive wear of the vane or rotor during operation of a pump mechanism.

The vane element 96 serves to divide the space between the rotor element and the cylindrical wall 48 on the pump chamber into variable volume intake and discharge chambers, the intake chamber being disposed in communication with the atmosphere through an intake aperture 104 having a filter element 106 disposed therein. Air will be caused to flow through the filter element 106 and into the intake chamber as the intake chamber enlarges during certain portions of the pump cycle. As the rotor continues to oscillate, air within the intake portion of the pump chamber will be conducted to the discharge portion of the chamber where it will be placed under compression as the space between the rotor and the cylindrical wall 48 of the pumping chamber decreases. The discharge chamber will be disposed in communication with an air supply passage 108 defined within the pump shaft 52 by means of recesses or channels formed in the wall structure of the housing, as illustrated in broken lines at 110 and 112. As shown in full lines in FIG. 1 and in broken line at FIG. 3, an air supply conduit 114 may be press-fitted within the lower extremity of the air supply passage 108 and may extend downwardly to the chuck tube 20 and may be received within an elongated passage 116 defined in the eraser strip 38. The air supply conduit 114 will extend in loose fitting relation within the bore 116 of the eraser strip 38, a sufficient length to maintain fluid communication between the conduit and the bore 116 of the eraser strip even when the eraser strip has been eroded away by erasing wear until it becomes quite short. The air supply conduit 114, if desired, may extend beyond the lower extremity of a chuck assembly 30 and may serve to lend additional structural integrity to the eraser strip as well as providing a means for delivering compressed air for cooling and for purposes of cleaning the immediate working area of the surface being erased of any deposit of erasure particles.

Figure 4:
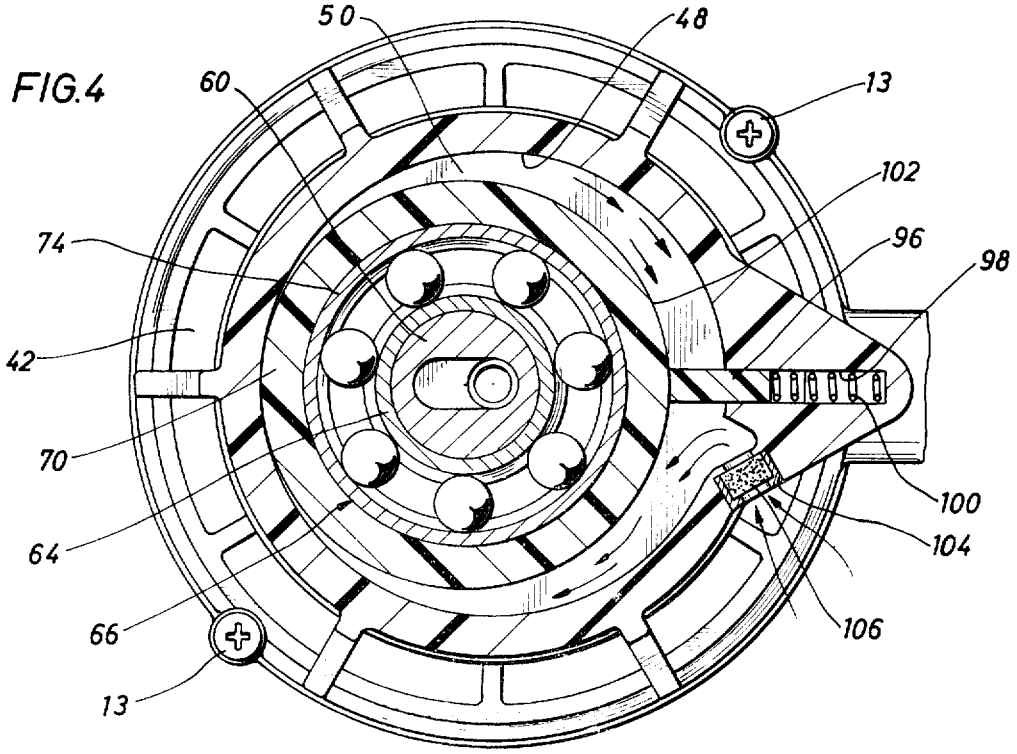
FIG. 4 is a sectional view taken along line 4—4 in FIG. 3.

The pumping operation is accomplished simply by eccentric movement of the rotor within the pumping chamber. As shown in FIG. 4, the intake and discharge chambers defined between the rotor and the wall 48 of the upper housing section 12*a* are approximately the same size. As the rotor is moved eccentrically in a clockwise direction from the position illustrated in FIG. 4, the discharge chamber will decrease in size, thereby compressing the air that is entrapped therein and forcing the compressed air to flow through the channels 110 and 112 to the discharge passage 108 defined in the pump shaft 52 where it will be conducted to the air supply passage defined along the length of the eraser strip. Simultaneously, the intake chamber will be enlarging and, because of the development of a low pressure condition therein, air will be drawn through the filter from the atmosphere and into the intake chamber. Continued clockwise rotation of the rotor within the pump chamber will conduct the air drawn into the intake chamber around the wall surface 84 where it will likewise be compressed and discharged in the manner described above.

During operation of the pump mechanism, the vane element 96 will reciprocate within its recess 98 against the influence of the compression spring 100. At the end of a compression stroke, the vane element will have been forced completely within the recess 98 by the surface 102 of the rotor. For further details of the rotary pumping operation, reference may be had to U.S. patent application Ser. No. 303,981, filed on Nov. 6, 1972 in the name of Clifford E. Anderson and entitled Gas Supply Mechanism for Erasing Machines.

As the erasing machine of FIG. 1 is operated, thereby inducing eccentric movement of the rotor 70 within the pump chamber, it is obvious that means is desired to prevent undesirable oscillation of the erasing machine. In order to accomplish this feature, a weight 118 may be fixed to the pump shaft 52 in such manner as to offset the eccentric weight of the rotor, the rotor bearing and the eccentric portion 60 of the pump shaft 52. The erasing machine of the present invention will therefore operate in smooth and efficient manner without excessive vibration.

Figure 2:
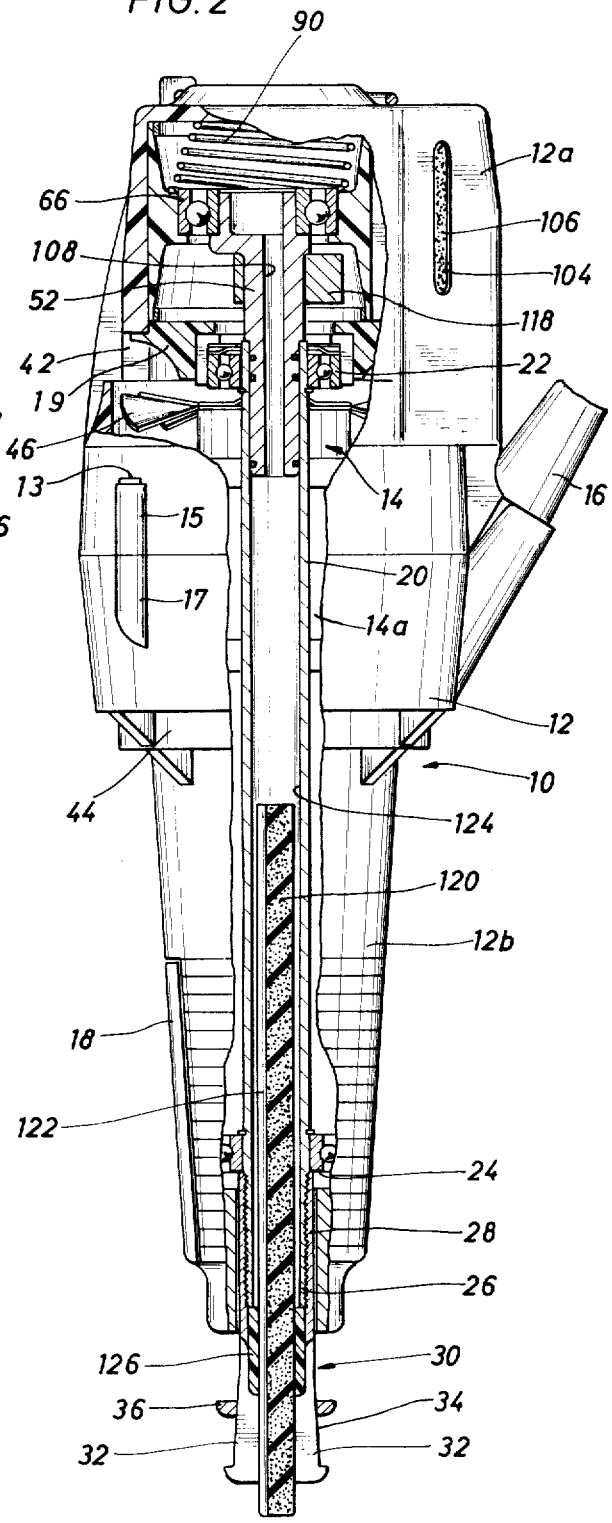
FIG. 2 is an elevational view having parts thereof broken away and shown in section, and illustrating an air blowing machine, comprising a modified embodiment of the structure illustrated in FIG. 1.

With reference now to FIG. 2, an erasing machine is illustrated which is constructed essentially identical to the erasing machine structure of FIG. 1, with exception of the features defining an air supply passage through the chuck tube mechanism and along the length of the eraser strip. It will not be necessary to provide an air supply conduit for conducting compressed air from the pump mechanism to the eraser strip. The eraser strip 120 may be formed to define an elongated groove 122 extending along the entire length thereof, which groove may cooperate with the cylindrical internal wall 124 of the chuck tube 20 to define an air passage extending along the length of the eraser strip and, thereby, serving to conduct a flow of compressed air from the pump mechanism and cause the same to be directed to the tip of the eraser strip for purposes of cooling and of particle cleaning.

As indicated above, the collet mechanism 30 is slotted at its lower extremity to define the collet segments 32. It is desirable therefore to provide means for preventing the escape of compressed air through the slots defining the collets, and such may be accomplished conveniently by the provision of a chuck seal element 126 that may be disposed within the collet and may be received in close fitting relation about the outer periphery of the eraser strip 20. The chuck seal may be composed of a yieldable material such as any one of a number of acceptable soft plastic materials and may serve to confine the flow of compressed air to the elongated groove 122 extending along the length of the eraser strip. The chuck seal 126 will function efficiently if the eraser strip is provided with a plurality of elongated grooves for the purpose of conducting flow of compressed air to the surface being erased.

Figure 5:
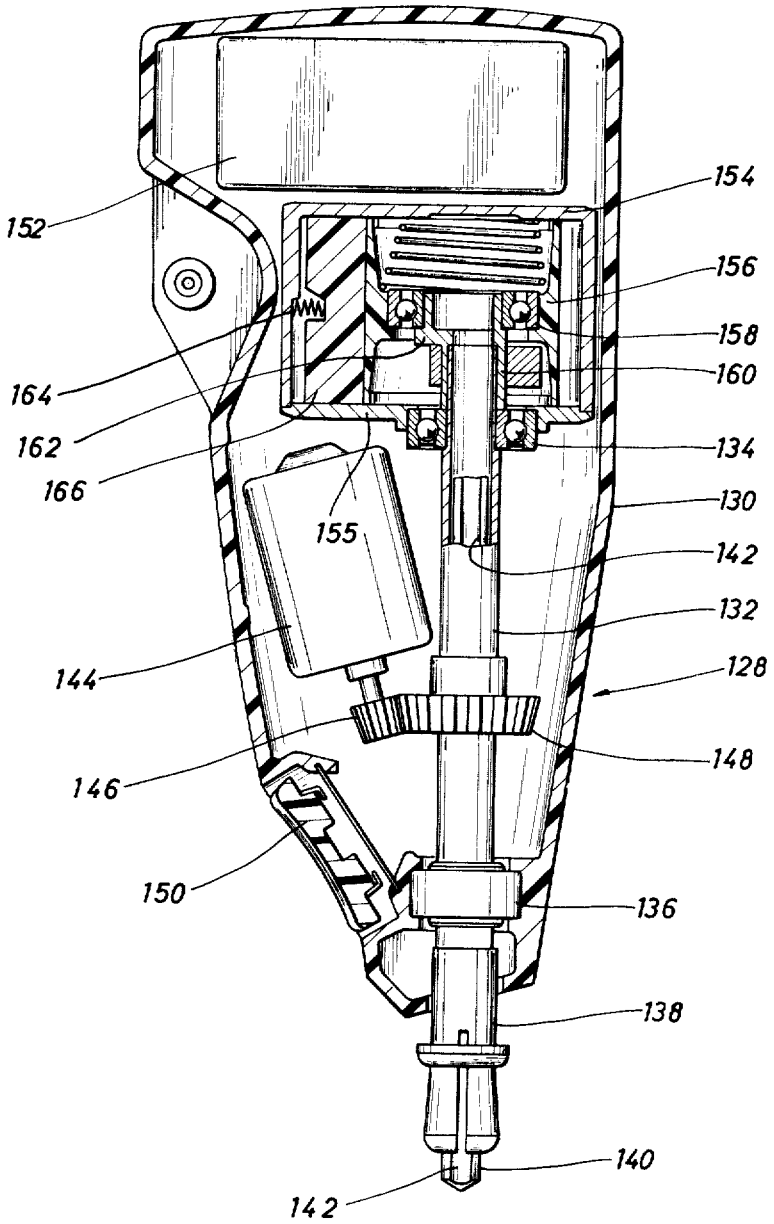
FIG. 5 is a sectional view in elevation representing a self-contained motor-driven, air blowing machine representing a modified embodiment of the present invention.

Referring now to FIG. 5, there is disclosed a self-contained electrically energized erasing machine generally at 128 which comprises a housing structure 130 within which is disposed a chuck tube 132 that is rotatably supported relative to the housing 154 and upper bearing flange 155 by upper and lower bearings 134 and 136. The lower extremity of the chuck tube 132 may be provided with a collet chuck mechanism 138 that may provide gripping support for an eraser strip 140 having an elongated groove 142 formed therein and extending along the length thereof.

The erasing machine 128 may be driven by an electrically energized DC motor 144 having a drive gear 146 that is disposed in driving relation with a driven gear 148 secured to the chuck shaft 132. The motor 144 will be energized through manual manipulation of a switch actuating element 150 to achieve selection energization of the motor 144 by energy contained within a battery 152 or other suitable supply of electrical potential.

Within the housing structure 130 may be defined a pump housing 154 within which may be disposed a rotor 156 constructed and functioning in the same manner as described above in connection with FIGS. 1 through 4. The rotor 156 may be supported by a bearing 158 to establish rotatable connection with a pump shaft 160 having an eccentric portion 162 defined at the upper extremity thereof. The pump shaft 160 may be disposed in driven relation with the chuck shaft 132, thereby causing the pump mechanism to be energized upon rotation of the motor 144. The air pump may also be provided with a vane element 166 that is urged by a spring 164 into engagement with the rotor 156, thereby causing the space between the rotor and the wall structure of the pump chamber to be partitioned into variable volume intake and discharge chambers that are constructed and function essentially the same as compared to the structures illustrated in FIGS. 1 through 4.

As the erasing machine is energized by manipulation of the switch element 150, the motor 144, being energized, induces rotation to the chuck shaft 132 to cause rotation of the eraser strip 140. Simultaneously, the chuck tube achieves rotation of the pump shaft 160, thereby inducing oscillation of the rotor 156 through its eccentric relationship with the pump shaft. The rotor, upon being oscillated eccentrically within the housing structure 154, causes air to be forced in cooperating manner through an air supply passage 166 defined within the chuck tube thereby causing a pulsating flow of air through the eraser groove 142, which air is directed against the surface being erased.

With reference now to FIGS. 6 through 9, a support or holding device is provided for the purpose of supporting the air supplying erasing machines of FIGS. 1, 2 and 4 in upright operating position when not in use. The support or holding device facilitates ready grasping of the erasing machine in optimum condition for use. The support or holding device is illustrated generally at 170 and may include an orienting surface 172 that may be disposed in engagement with a vertical planar surface, such as a side surface of a drafting table, the end of a desk drawer or an inside surface of a desk drawer, etc. The holder may be composed of any suitable material such as any one of a number of acceptable plastic or metal materials and may include opposed support wings 174 and 176 having recesses 178 and 180 formed therein. Screws, or other suitable connection devices, such as illustrated at 182 in FIG. 9, may be received within the recesses 178 and 180 for the purpose of securing the wings 174 and 176 into supporting abutment with a generally vertically disposed planar surface. Although the holding device is adapted to function efficiently when connected to a structure having a vertically disposed surface, it is not intended to limit use of a device to a surface that is vertically oriented, it being obvious that such surface may depart from the vertical without creating adverse effects. It is also obvious that various surfaces of the holding device may be oriented in such manner as to achieve proper orientation of an erasing machine when the support device is connected to a structure having a surface that is disposed in angular relationship to the vertical.

As illustrated in FIG. 6, the holding device may be provided with an upper surface 184 there may be disposed in acute angular relationship with the planar surface 172 and a support passage 186 may be defined within the holder device, which passage may be actually oriented in substantially normal relationship to the planar surface 184 thereby causing the passage 186 to be disposed in acute angular relationship with the surface 172.

The passage 186, extending through the support device 170, may be of such configuration as to substantially fit the lower configuration of an electrically energized erasing machine. The passage 186 may be provided with an enlarged upper portion 188 that receives that portion of the erasing machine that is ordinarily gripped during an erasing operation. The passage 186 may also be defined by a reduced diameter lower portion 190 that cooperates with the enlarged upper portion 188 to define support shoulder portion 192 that may support a majority of the weight of the erasing machine. The angular relationship of the passage 186 relative to the vertical causes the erasing machine to tend to pivot outwardly, thereby causing the support portion thereof to have point bearing at 194 with the holder device. This of course causes the lower portion of the erasing machine to have point supporting contact with the holding device at 196, which point contact cooperates with point contact 194 to cause the erasing machine to be centered and positioned properly for grasping and removal from the holding device as the machine is to be used. After use of the machine has terminated, the operator may simply place the lower extremity of the erasing machine back into the receptacle defined by the passage 186 and simply release the machine. The machine, upon being released, will assume the optimum designed position for storage indicated above. The operator, upon desiring use of the machine for a further erasing operation, may simply reach and grasp the machine without looking while doing so because the machine will always be disposed in optimum position for ready grasping while being stored in this manner.

In view of the foregoing, it is apparent that I have provided a novel electrically energized air blowing machine such as an erasing machine that effectively facilitates efficient machining operations. I have also provided a machine that is capable of blowing a pulsating stream of air and directing the same against the work surface in the immediate vicinity of the contact point between a tool held by the machine and the surface for the purpose of cooling the tool to prolong its useful life and for cooling the work surface to protect it from overheating and burning due to the friction developed during working operations. The machine of my invention may utilize an eccentric type pump mechanism for the purpose of generating a flow of air for cleaning and cooling purposes which pump mechanism may be operative by a simultaneously energized pump motor, if desired, or may be driven by the operating motor of the machine itself. The air supply mechanism of my invention may be incorporated within the housing structure of an erasing machine, thereby providing an erasing machine structure that is small and compact and is not in any way objectionable in use. An erasing machine constructed in accordance with my invention facilitates more efficient drafting operations because it is not necessary to periodically stop the erasing operation and to grasp a brush for cleaning operations as is typically the case. The erasing operation is also made more efficient due to prolongation of the effective service life of an eraser strip due to the cooling capability of the mechanism I have developed.

It is therefore understood that my invention is one well adapted to obtain all of the objects and advantages hereinabove set forth, together with other advantages which will become obvious and inherent from a description of the apparatus itself. It will be understood that certain combinations and subcombinations are of utility and may be employed without reference to other features and subcombinations. This is contemplated by and is within the scope of the present invention.

Although only representative embodiments of the invention have been described and shown, it is intended that numerous modifications may be made possible by one skilled in the art without departing from the spirit or scope of the present invention. It is to be further understood that the embodiments described and illustrated herein are merely illustrative of an application of the principles of the invention and that numerous other arrangements and modifications may be made in the structures illustrated without departing from the spirit and scope of this invention.

Having thus fully described my invention, I claim:

1. A motor driven erasing machine having a housing, a chuck tube being disposed within said housing and being rotatably driven by an electrically energized motor, said chuck tube having a chuck mechanism at the lower extremity thereof for supporting a strip of erasing material, the improvement comprising:

means defining air passage means within said chuck tube and extending lengthwise of said eraser strip and directing air flowing therethrough against the surface being erased in the immediate vicinity of the area of contact between the eraser strip and the surface being erased;

air supply means completely enclosed within said housing and developing a flow of air simultaneously with energization of said electric motor;

and means communicating said flow of air with said air passage means.

2. A motor driven erasing machine as recited in claim 1:

said chuck tube and said eraser strip cooperating to define a space therebetween, said air passage means being defined by said space between said chuck tube and said strip of erasing material.

3. A motor driven erasing machine as recited in claim 1:

said means defining said air passage means comprising elongated groove means being defined in said strip and extending lengthwise of said eraser strip, said groove means cooperating with said chuck tube to define said air passage.

4. A motor driven erasing machine as recited in claim 1:

said means developing a flow of air being a pump mechanism disposed within said housing and defining air suction and discharge means; and said air discharge means being communicated with said air passage means.

5. A motor driven erasing machine as recited in claim 4:

said pump mechanism being driven by said motor of said erasing machine.

6. A motor driven erasing machine as recited in claim 4:

said housing defining a pump chamber;

rotor shaft means being rotatably disposed within said pump chamber;

bearing means carried by said housing and providing rotatable support for said rotor shaft means;

rotor means being eccentrically carried by said rotor shaft means and being oscillatable within said pump chamber upon rotation of said rotor shaft means;

follower vane means being movably received within said housing and being disposed in engagement with said rotor, said follower vane means defining a movable partition separating the space between said rotor and said housing into variable volume suction and compression chambers; and means urging said follower vane means into engagement with said rotor at all times.

7. A motor driven erasing machine as recited in claim 6:

said rotor shaft means having a passage formed therein, said passage conducting air from said pump means to said air passage means.

8. A motor driven erasing machine as recited in claim 6:

first bearing means being interposed between said rotor shaft means and said rotor means;

said rotor shaft means having a rotor drive portion formed eccentrically thereon; and second bearing means being received by said rotor drive portion of said shaft means, said second bearing means being received by said rotor means and supporting said rotor means relative to said rotor shaft means.

9. A motor driven erasing machine as recited in claim 6:

said rotor shaft means having a generally cylindrical surface eccentrically defined thereon;

bearing means received by said cylindrical surface and rotatably supporting said rotor means on said rotor shaft means;

said housing having a generally cylindrical internal wall surface defining said pump chamber; and said rotor having a generally cylindrical peripheral surface moving in close proximity with said cylindrical wall upon rotation of said rotor shaft means.

10. A motor driven erasing machine as recited in claim 9:

counterweight means being carried by said rotor shaft means and preventing vibration of said air erasing machine upon oscillation of said rotor within said housing.

11. A motor driven machine for simultaneously doing work on a work surface and blowing loose particles from said surface and cooling the contact area between a tool carried by the machine and the work surface, said machine comprising:

housing means defining a tool section and a pump section chuck tube means being disposed for rotation within said tool section and having chuck means disposed at one extremity thereof for supporting a tool, said tool extending at least partially through said chuck means and into said chuck tube means;

electric motor means being disposed within said tool section of said housing and being connected to said chuck tube, said motor means imparting rotation to said chuck tube, said chuck and said tool upon being energized;

means defining an air passage extending lengthwise of said chuck tube means and said tool;

pump means disposed within said pump section of said housing and developing a flow of air; and means communicating said pump means with said air passage means and directing the flow of air from said pump means to said air passage means.

12. A motor driven machine as recited in claim 11:

said pump means being driven by said motor means.

13. A motor driven machine as recited in claim 11, wherein said pump means comprises:

rotor means being disposed within said pump section of said housing;

shaft means being rotatably supported within said pump section and having a generally cylindrical portion thereof disposed eccentrically thereof;

said rotor means being disposed about said cylindrical portion and, upon rotation, causing eccentric oscillation of said rotor means within said pump section of said housing means;

follower vane means being movably received within said pump section of said housing means and being disposed in engagement with said rotor means, said follower vane means defining a movable partition separating the space between said rotor and said housing into variable volume intake and compression chambers; and means urging said follower vane means into engagement with said rotor at all times.

14. A motor driven machine as recited in claim 13:

means disposed within said pump section of said housing means and retarding rotation of said rotor means relative to said housing.

15. A motor driven machine as recited in claim 14, wherein:

said means retarding rotation of said rotor means relative to said housing comprises spring means disposed in nonrotatable relation with said housing, said spring means being disposed in engagement with said rotor means, said engagement preventing free rotation of said rotor means.

16. A motor driven machine as recited in claim 13: counterweight means being carried by said shaft means and substantially preventing vibration of said machine upon oscillation of said rotor means therein.

17. A motor driven machine as recited in claim 11: said shaft means having a passage formed therein and conducting the flow of air from said pump means to said air passage.

18. A motor driven machine as recited in claim 11: said shaft means having a connector portion defined thereon, said connector portion being received in driven relation with said chuck tube.

* * * * *